US008641375B2

(12) United States Patent
Tian et al.

(10) Patent No.: US 8,641,375 B2
(45) Date of Patent: Feb. 4, 2014

(54) CEILING RECESSED VENTILATING FAN WITH ILLUMINATING DEVICE

(75) Inventors: Liang Tian, Guangdong (CN); Kai Tan, Guangdong (CN)

(73) Assignees: Panasonic Ecology Systems Guangdong Co. Ltd., Foshan, Guangdong (CN); Panasonic Corporation, Osaka (JP)

( * ) Notice: Subject to any disclaimer, the term of this patent is extended or adjusted under 35 U.S.C. 154(b) by 637 days.

(21) Appl. No.: 12/863,290

(22) PCT Filed: Nov. 24, 2009

(86) PCT No.: PCT/CN2009/001312

§ 371 (c)(1), (2), (4) Date: Oct. 14, 2010

(87) PCT Pub. No.: WO2010/060278

PCT Pub. Date: Jun. 3, 2010

(65) Prior Publication Data

US 2011/0044814 A1 Feb. 24, 2011

(30) Foreign Application Priority Data

Nov. 28, 2008 (CN) ..... 2008 2 0176847 U

(51) Int. Cl.
*F04D 29/00* (2006.01)

(52) U.S. Cl.
USPC ..... 416/5; 415/121.2; 415/203; 415/204; 415/206

(58) Field of Classification Search
USPC ..... 416/5; 415/121.2, 203, 204, 206
See application file for complete search history.

(56) References Cited

U.S. PATENT DOCUMENTS

| | | | | |
|---|---|---|---|---|
| 5,443,625 | A * | 8/1995 | Schaffhausen | 95/113 |
| 6,244,720 | B1 | 6/2001 | Neff | |
| 7,083,659 | B1 * | 8/2006 | Joyce et al. | 55/385.1 |

FOREIGN PATENT DOCUMENTS

| | | |
|---|---|---|
| CN | 2677745 | 2/2005 |
| CN | 2763384 | 3/2006 |
| CN | 201322410 | 10/2009 |
| GB | 864894 | 4/1961 |
| JP | 08-271009 | 8/1996 |
| JP | 2005243582 | 9/2005 |

OTHER PUBLICATIONS

International Search Report dated Feb. 23, 2010.

* cited by examiner

*Primary Examiner* — Igor Kershteyn
(74) *Attorney, Agent, or Firm* — RatnerPrestia

(57) ABSTRACT

Disclosed is a ceiling recessed ventilating fan with illuminating device, including a body, a blower disposed horizontally within the body and an illuminating device disposed inside the body. The illuminating device is disposed around an air inlet of the blower. The illuminating device is disposed within the body, and does not protrude from the surface of the ceiling.

8 Claims, 6 Drawing Sheets

CEILING RECESSED VENTILATING FAN WITH ILLUMINATING DEVICE

This application claims priority of PCT International Application No. PCT/CN2009/001312 filed Nov. 4, 2009. The contents of which are incorporated hereby by reference.

FIELD OF THE INVENTION

The present invention relates to a ventilating fan, and more particularly, to a ceiling recessed ventilating fan with an illuminating device mounted in the ceiling.

BACKGROUND OF THE INVENTION

FIG. 1 is a schematic view of a ceiling recessed ventilating fan 1000 with an illuminating device disclosed in Japanese patent publication No. 8-271009, including a body 200 recessed into the ceiling 100, an air inlet 210 provided at a lower portion of the body 200 under the surface of the ceiling, a hood 220 for covering the air inlet 210, and an illuminating device 230 provided on the hood 220.

In the conventional ceiling recessed ventilating fan with the illuminating device as mentioned above, the illuminating device 230 protrudes from the surface of the ceiling 100 and is disposed under the ceiling 100. Such arrangement may impose people a compression feeling.

SUMMARY OF THE INVENTION

The present invention provides a ceiling recessed ventilating fan with an illuminating device, which is less protruded from the ceiling and does not impose people a compression feeling.

In order to achieve the above object, the present invention provides a ceiling recessed ventilating fan with illuminating device, comprising a body recessed into a ceiling, a blower horizontally disposed inside the body, and an illuminating device disposed at a lower portion of the body; the illuminating device is disposed around an air inlet of the blower at an inner side of the ceiling.

The illuminating device has an annular light emitting portion and is disposed along an air path from a lower opening of the body to the air inlet of the blower.

A grating is disposed in the air path from a lower opening of the body to the air inlet of the blower, and the illuminating device is disposed below the grating.

An air guide device is provided for connecting the lower opening of the body and the air inlet of the blower, and the illuminating device is disposed over a portion of the air guide device.

At least a portion of the air guide device is formed into an illumination and light transmission structure.

The illumination and light transmission structure is made of transparent or translucent material.

The air guide device is of a round and flaring shape, and the illuminating device comprises a round fluorescent tube and is provided on the air guide device.

The air guide device is of a quadrangular and flaring shape, and the illuminating device comprises a straight fluorescent tube and is provided at the respective sides of the air guide device.

The air guide device covers the interface between the body and the ceiling, and is coupled to the air inlet of the blower.

The advantage of the present invention is that the illuminating device is disposed inside the body and does not protrude outside the surface of the ceiling, such that the position of the whole ventilating fan is high and thus the user will not feel compressed. At the same time, the illuminating device is disposed around the air inlet and thus will not block the intake air when the ventilation is performed.

DETAILED DESCRIPTION OF THE PREFERRED EMBODIMENTS

Figure 1:
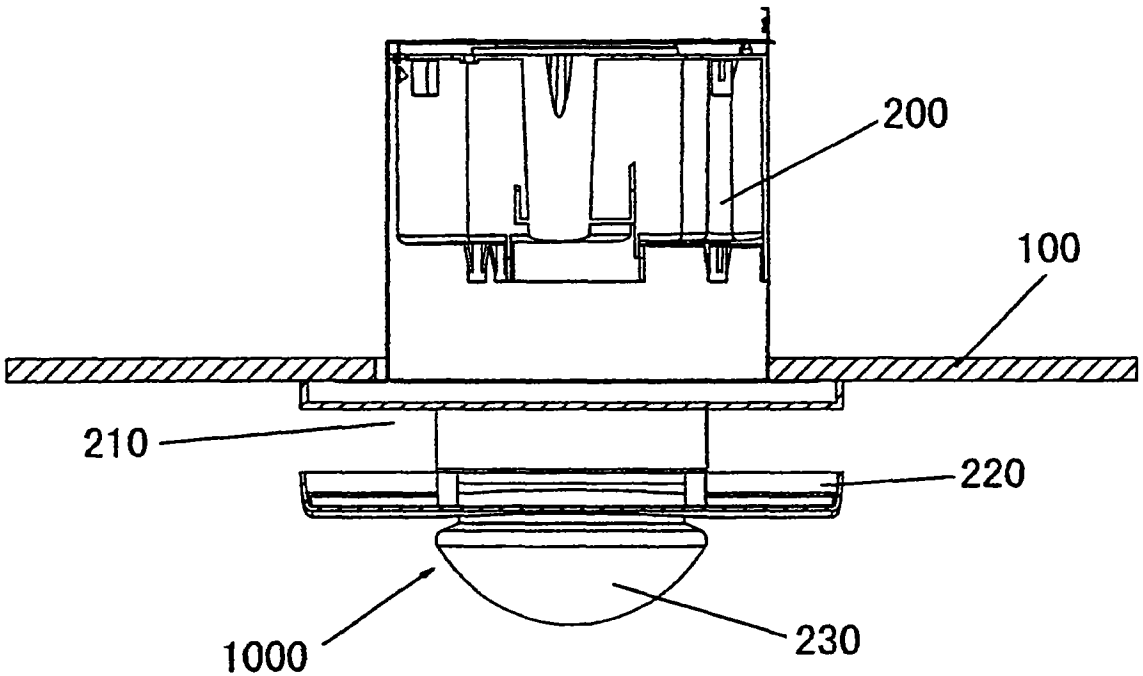
Fig. 1 (prior art)
FIG. 1 is a schematic view of a conventional ceiling recessed ventilating fan with an illuminating device.
Figure 2:
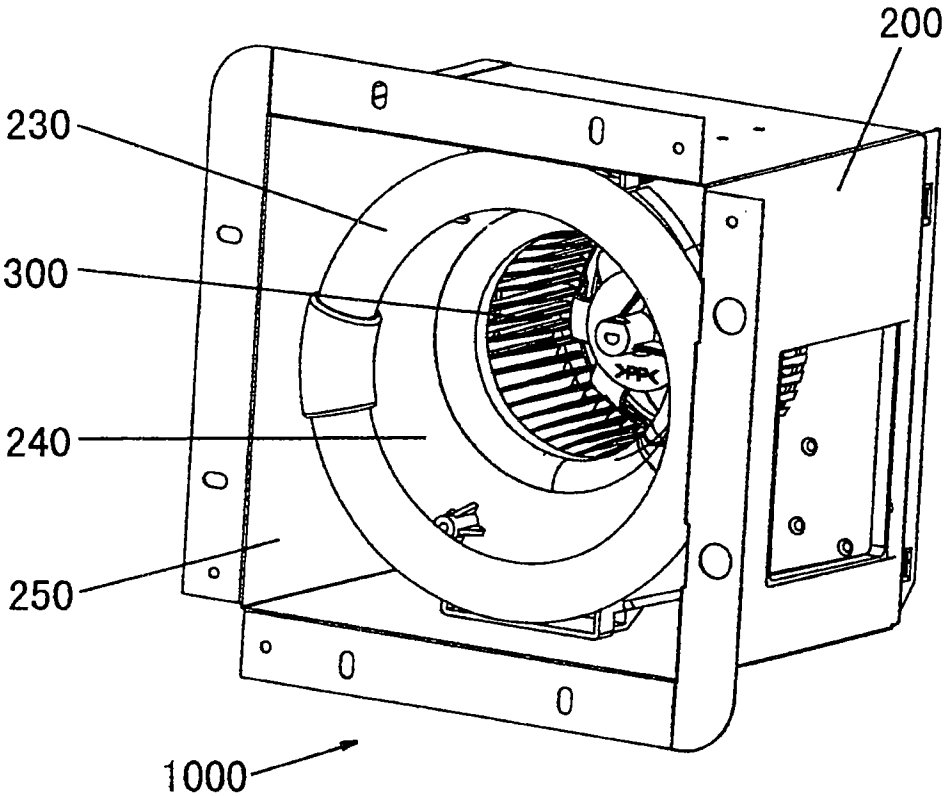
FIG. 2 is a schematic view of a ceiling recessed ventilating fan with an illuminating device according to a first embodiment of the present invention.

FIG. 2 is a schematic view of a ceiling recessed ventilating fan with an illuminating device according to a first embodiment of the present invention. The ceiling recessed ventilating fan with the illuminating device 1000 comprises a body 200 and a blower 300 horizontally disposed inside the body 200. The illuminating device 230 with an annular light emitting portion is disposed along an air path from a lower opening 250 of the body 200 to an air inlet 240 of the blower 300 and surrounds the air inlet 240 of the blower 300. Since the illuminating device 230 is disposed inside the body 200, it does not protrude outside the surface of a ceiling (not shown in the FIG. 2) and illuminates the indoor from the inside of the body 200 of the ventilating fan. Further, since the illuminating device 230 is disposed around the air inlet 240, it will not block the intake air when the ventilation is performed.

Figure 3:
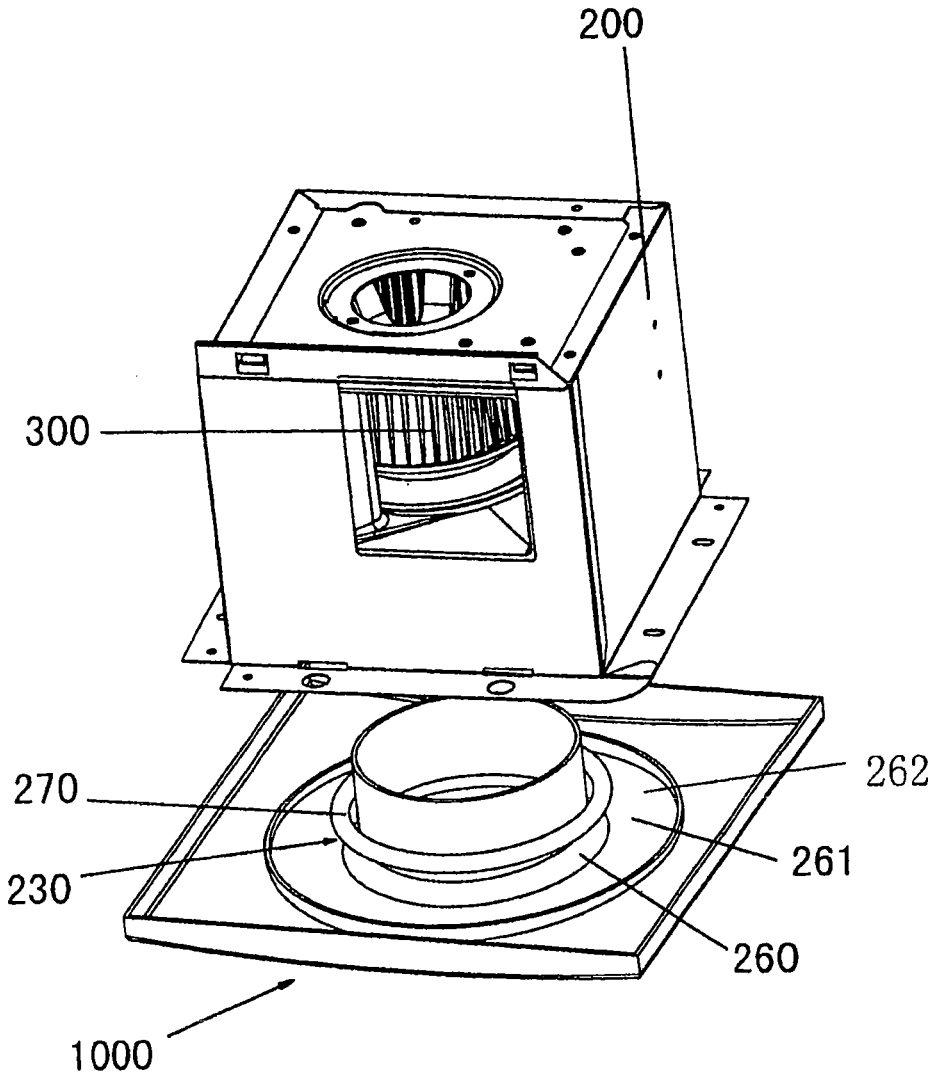
FIG. 3 is a schematic view of a ceiling recessed ventilating fan with an illuminating device according to a second embodiment of the present invention.

FIG. 3 is a schematic view of a ceiling recessed ventilating fan with an illuminating device according to a second embodiment of the present invention. The ceiling recessed ventilating fan with the illuminating device 1000 comprises a body 200 and a blower 300 horizontally disposed inside the body 200. The ventilating fan further comprises an air guide device 260 for connecting an lower opening of the body 200 (not shown in the FIG. 3) and an air inlet of the blower 300 (not shown in the FIG. 3). The air guide device 260 has a round and flaring shape. A portion 261 of the air guide device, for example, a portion from the skirt portion of the flaring shape to the horizontal portion, is made of transparent material such as propylene or translucent material such as polycarbonate so as to form an illumination and light transmission structure 262 for illumination. Further, the illuminating device 230 composed of a round fluorescent tube 270 which forms an annular light emitting portion is disposed on the portion 261 of the air guide device 260. With such arrangement, the light emitted from the fluorescent tube 270 may be transmitted through the illumination and light transmission structure 262 in the air guide device 260, but the whole illuminating device 230 is still disposed inside the body 200 and does not protrude from the surface of the ceiling (not shown in the drawing 3). At the same time, the indoor air is drawn by the blower 300 along the air guide device 260. The ventilation function and the illumination function do not interfere with each other.

Further, the round fluorescent tube 270 which forms an annular light emitting portion in the present embodiment may be a light emitting portion composed of a plurality of point light sources such as a LED.

Further, the portion 261 of the air guide device 260 is formed as an illumination and light transmission structure 262. It can be appreciated for the skilled in the art that the whole air guide device 260 may be formed as an illumination and light transmission structure 262 by the above mentioned translucent material. Further, the translucent material may also be formed of propylene, glass, etc.

Referring to FIG. 3 again, the air guide device 260 covers the interface between the body 200 and the ceiling (not shown in the FIG. 3) and coupled to the air inlet (now shown in the drawing) of the blower 300. In this regards, the air guide device 260 doubles as a hood for covering the lower opening (not shown in the drawing) of the body 200 of the ceiling recessed ventilating fan 1000; and at the same time, it covers a flange of the body 200 for guiding air into the air inlet (not shown in the FIG. 3) of the blower 300. Since the air guide device 260 may double as a hood, the structure of the ventilating fan is simplified.

Figure 4:
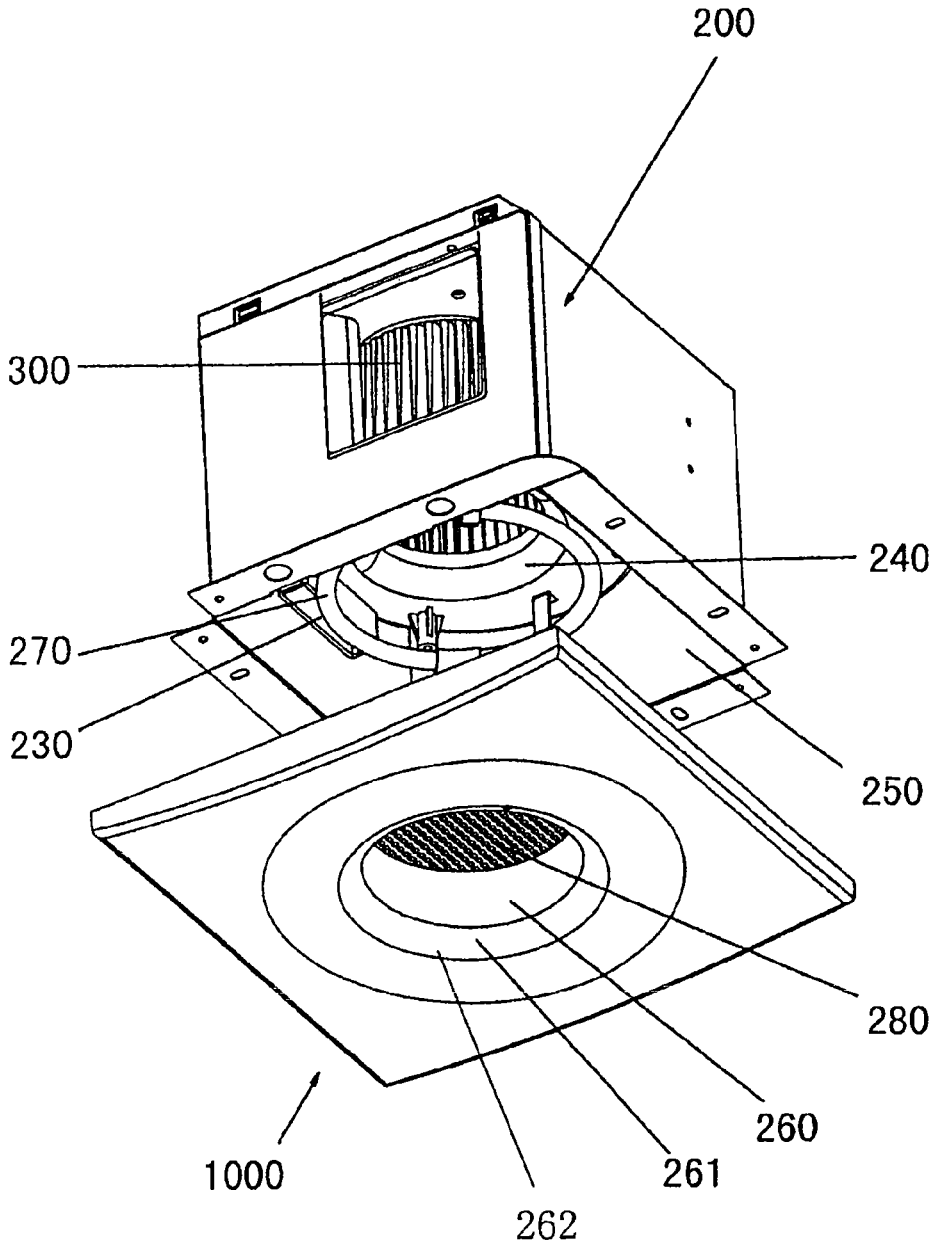
FIGS. 4 and 5 are schematic views of a ceiling recessed ventilating fan with an illuminating device according to a third embodiment of the present invention.
Figure 5:
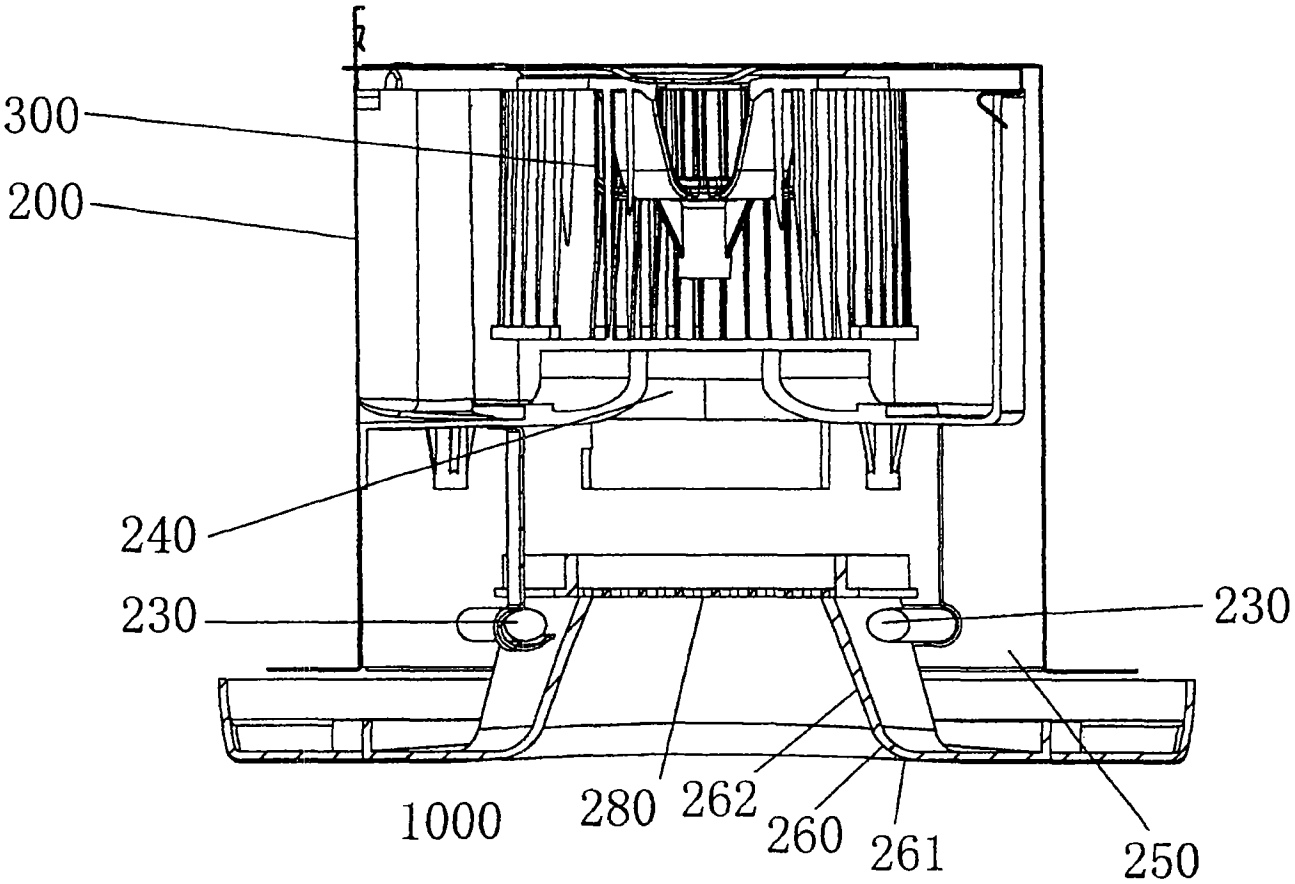

FIGS. 4 and 5 are schematic views of a ceiling recessed ventilating fan with an illuminating device according to a third embodiment of the present invention. Compared with the illuminating device of the conventional ventilating fan which protrudes outside the ceiling, the illuminating device 230 disposed inside the body 200 as described in the second embodiment of the present invention has a narrow illuminating range and an imperfect intensity. That is, the light can not be radiated outwardly and radially from the illuminating device, and therefore the illumination intensity of the illuminating device is reduced. Considering this, in the third embodiment, in contrast to the second embodiment, the illumination and light transmission structure 262 is disposed at a substantially vertical portion of the air guide device 260. That is, the illumination and light transmission structure 262 is disposed at a portion of the air guide device 260 from the horizontal portion of the skirt of the flaring shape to the substantially vertical portion of the skirt, i.e., the portion for connecting the lower opening 250 of the body 200 and the air inlet 240 of the blower 300. Further, a grating 280 of lattice shape is disposed at a portion closer to the air inlet 240 of the blower 300 than the illuminating device 230.

As mentioned above, like the second embodiment, according to the third embodiment, the light emitted from the fluorescent tube 270 may be transmitted through the illumination and light transmission structure 262 of the air guide device 260, and the whole illuminating device 230 is disposed inside the body of the ventilating fan and does not protrude outside the surface of the ceiling (not shown in the FIGS. 4 and 5) and can illuminate the room brightly. At the same time, the indoor air is drawn by the blower 300 along the air guide device 260. The ventilation function and the illuminating function will not interfere with each other.

Further, like the present embodiment, the illumination and light transmission structure 262 serves as the portion for connecting the lower opening 250 of the body 200 and the air inlet 240 of the blower 300 and disposed from the substantially vertical portion of the skirt of the flaring shape to the horizontal portion of the skirt so that the irradiating range of the light from the illuminating device is broadened with the help of the flaring shape of the portion. At the same time, the illumination intensity of the room can be guaranteed.

Further, the grating 280 of lattice shape is disposed at a portion closer to the air inlet 240 of the blower 300 than the illuminating device 230. That is, by arranging the illuminating device 230 lower than the grating 280, the light may irradiate the inside of the room directly without irradiating on the grating 280.

Further, when the room is ventilated, the grating 280 for passing the air is more likely to be contaminated than the conventional grating provided on the illuminating device. If the illuminating device 230 is disposed above the grating 280, the dirty on the grating will be more apparent. Therefore, in the present embodiment, the illuminating device 230 is disposed below the grating 280, the dirty will be less apparent as compared with the situation described above.

Figure 6:
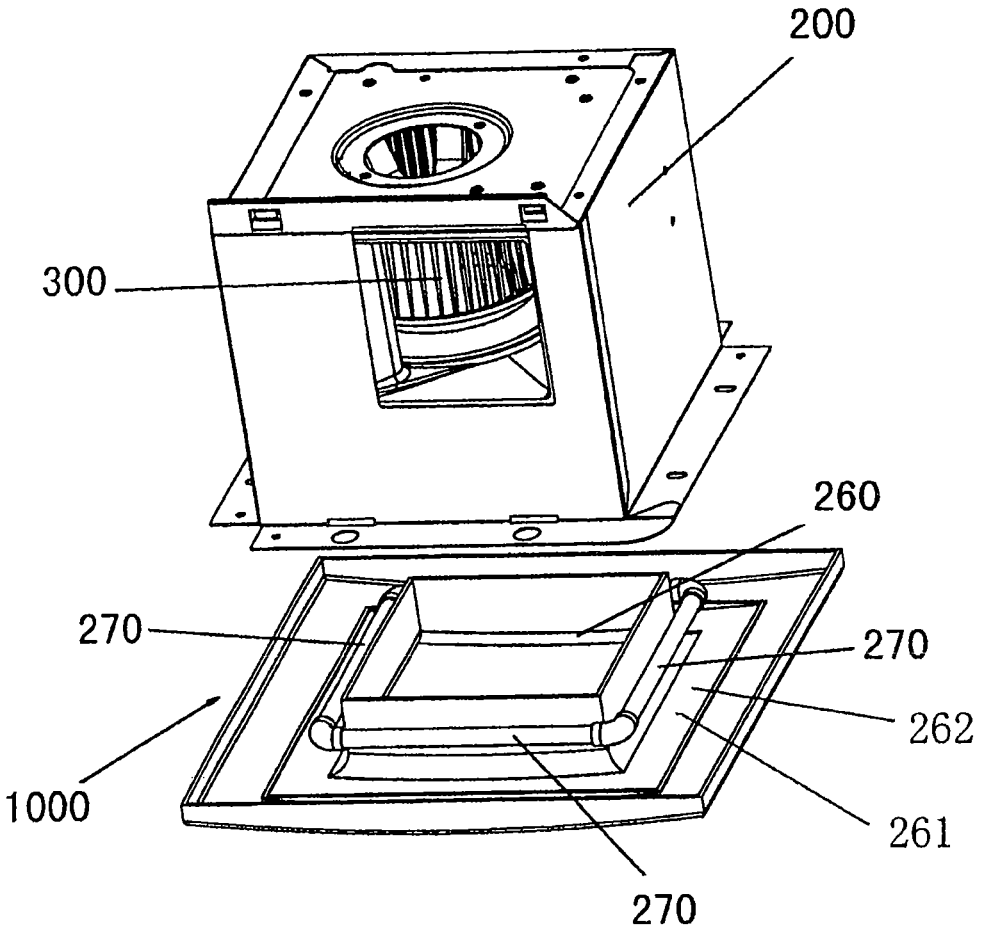
FIG. 6 is a schematic view of a ceiling recessed ventilating fan with an illuminating device according to a fourth embodiment of the present invention.

FIG. 6 is a schematic view of a ceiling recessed ventilating fan with an illuminating device according to a fourth embodiment of the present invention. As shown in FIG. 6, the fourth embodiment is different from the third embodiment in the shape of the air guide device 260 and the shape of the fluorescent tube 270. In the present fourth embodiment, the air guide device 260 is of a quadrangular and flaring shape, and an illuminating device with straight fluorescent tube 270 is provided at the respective sides of the air guide device 260. The air in the room is drawn by the blower 300 along the air guide device 260. Further, a portion of the air guide device 260 is of annular shape and emits light for irradiating the room.

Although the embodiments of the present invention have been described and illustrated above, it will be appreciated by those skilled in the art that the embodiments can be further modified and changed in various ways without departing from the scope of the claims.

What is claimed is:

1. A ceiling recessed ventilating fan with illuminating device, comprising a body configured to be recessed into a ceiling, a blower horizontally disposed inside the body, an illuminating device disposed at a lower portion of the body, and an air guide device that covers a lower opening of the body and forms an air passageway to an air inlet of the blower, wherein the illuminating device is disposed over a portion of the air guide device at an inner side of the ceiling.

2. The ceiling recessed ventilating fan with illuminating device according to claim 1, wherein the illuminating device has an annular light emitting portion and is disposed along an air path from a lower opening of the body to the air inlet of the blower.

3. The ceiling recessed ventilating fan with illuminating device according to claim 1, wherein a grating is disposed in the air path from a lower opening of the body to the air inlet of the blower, and the illuminating device is disposed below the grating.

4. The ceiling recessed ventilating fan with illuminating device according to claim 1, wherein at least a portion of the air guide device is formed into an illumination and light transmission structure.

5. The ceiling recessed ventilating fan with illuminating device according to claim 4, wherein the illumination and light transmission structure is made of transparent or translucent material.

6. The ceiling recessed ventilating fan with illuminating device according to claim 1, wherein the air guide device is of a round and faring shape, and the illuminating device comprises a round fluorescent tube and is provided on the air guide device.

7. The ceiling recessed ventilating fan with illuminating device according to claim 1, wherein the air guide device is of a quadrangular and flaring shape, and the illuminating device comprises a straight fluorescent tube and is provided at the respective sides of the air guide device.

8. The ceiling recessed ventilating fan with illuminating device according to claim 1, wherein the air guide device covers the interface between the body and the ceiling, and is coupled to the air inlet of the blower.

* * * * *